US007768412B2

(12) United States Patent
Vokey

(10) Patent No.: US 7,768,412 B2
(45) Date of Patent: Aug. 3, 2010

(54) MOISTURE MONITORING SYSTEM FOR BUILDINGS

(75) Inventor: David E. Vokey, Sidney (CA)

(73) Assignee: Detec Systems LLC, Sidney, British Columbia (CA)

( * ) Notice: Subject to any disclaimer, the term of this patent is extended or adjusted under 35 U.S.C. 154(b) by 539 days.

(21) Appl. No.: 11/833,444

(22) Filed: Aug. 3, 2007

(65) Prior Publication Data

US 2009/0033507 A1 Feb. 5, 2009

(51) Int. Cl.
*G08B 21/00* (2006.01)

(52) U.S. Cl. ..... 340/604; 340/603; 340/602; 340/521; 702/127; 702/188; 702/51

(58) Field of Classification Search ..... 340/604, 340/603, 602, 521; 324/648; 702/127, 188, 702/51; 73/49.1, 40, 40.5 R
See application file for complete search history.

(56) References Cited

U.S. PATENT DOCUMENTS

| | | | | |
|---|---|---|---|---|
| 4,502,044 | A | 2/1985 | Farris | |
| 5,081,422 | A | 1/1992 | Shih | |
| 5,176,316 | A * | 1/1993 | Whitman | 236/44 C |
| 5,708,195 | A * | 1/1998 | Kurisu et al. | 73/40.5 R |
| 5,883,815 | A * | 3/1999 | Drakulich et al. | 702/51 |
| 5,942,904 | A * | 8/1999 | Schuhmann et al. | 324/648 |
| 6,144,209 | A | 11/2000 | Raymond | |
| 6,175,310 | B1 | 1/2001 | Gott | |
| 6,377,181 | B1 * | 4/2002 | Kroll et al. | 340/604 |
| 7,082,827 | B1 * | 8/2006 | Samuelson | 73/308 |
| 7,126,486 | B2 * | 10/2006 | Kroll et al. | 340/604 |
| 7,130,757 | B2 * | 10/2006 | Corwin et al. | 702/127 |
| 7,203,576 | B1 * | 4/2007 | Wilson et al. | 700/284 |
| 7,230,528 | B2 | 6/2007 | Kates | |
| 7,243,050 | B2 * | 7/2007 | Armstrong | 702/188 |
| 7,272,896 | B2 * | 9/2007 | Kou | 34/527 |
| 7,289,918 | B2 * | 10/2007 | Nagase | 702/51 |
| 7,574,320 | B2 * | 8/2009 | Corwin et al. | 702/127 |
| 2002/0052719 | A1 * | 5/2002 | Alexander et al. | 702/188 |

(Continued)

FOREIGN PATENT DOCUMENTS

| | | |
|---|---|---|
| CA | 2510354 | 9/2005 |

(Continued)

*Primary Examiner*—Davetta W Goins
*Assistant Examiner*—Hoi C Lau
(74) *Attorney, Agent, or Firm*—Adrian D. Battison; Ade & Company Inc.

(57) ABSTRACT

A method of monitoring moisture in a building is carried out using moisture detectors, which provide an output resistance value ranging from a dry value in the absence of moisture and different wet values in the presence of moisture depending on the quantity of moisture. Rather than emit an alarm based solely on a moisture threshold, a risk assessment of potential damage is calculated for at least a part of the building using the wet values from the moisture detectors for the sensor zones using as input data the wet values and as a first additional factor a value which is indicative of a total area of the moisture as provided by the number of sensor zones that are responding with a wet value and as a second additional value the number of consecutive time periods that the sensor zone has reported wet value. The calculation can use computer modeling to calculate a risk factor for growth of mold or a risk factor for growth of timber decay fungi.

17 Claims, 2 Drawing Sheets

U.S. PATENT DOCUMENTS

| | | | | |
|---|---|---|---|---|
| 2003/0222783 | A1 | 12/2003 | Amacher | |
| 2004/0122602 | A1* | 6/2004 | Nagase | 702/51 |
| 2005/0131652 | A1* | 6/2005 | Corwin et al. | 702/127 |
| 2006/0005312 | A1 | 1/2006 | Reddey et al. | |
| 2006/0047419 | A1* | 3/2006 | Diendorf et al. | 701/208 |
| 2006/0092031 | A1 | 5/2006 | Vokey et al. | |
| 2006/0174707 | A1* | 8/2006 | Zhang | 73/592 |
| 2006/0191323 | A1* | 8/2006 | Garabedian et al. | 73/40 |
| 2006/0191324 | A1* | 8/2006 | Garabedian et al. | 73/40 |
| 2006/0217934 | A1* | 9/2006 | Armstrong | 702/188 |
| 2006/0244616 | A1 | 11/2006 | Hill | |
| 2007/0046481 | A1 | 3/2007 | Vokey | |
| 2007/0093982 | A1* | 4/2007 | Corwin et al. | 702/127 |
| 2007/0139183 | A1* | 6/2007 | Kates | 340/521 |
| 2007/0139208 | A1 | 6/2007 | Kates | |
| 2008/0060421 | A1* | 3/2008 | Muller et al. | 73/49.2 |
| 2008/0141761 | A1* | 6/2008 | Lohman | 73/49.1 |
| 2008/0262737 | A1* | 10/2008 | Thigpen et al. | 702/9 |
| 2009/0112525 | A1* | 4/2009 | Adani | 702/189 |

FOREIGN PATENT DOCUMENTS

| | | |
|---|---|---|
| GB | 2235535 | 6/1991 |
| WO | WO 2005/010837 | 2/2005 |

* cited by examiner

MOISTURE MONITORING SYSTEM FOR BUILDINGS

The present invention relates to a system for monitoring structures for the presence and accumulation of moisture. It has particular application to monitoring residential and commercial buildings for undesired water ingress.

BACKGROUND OF THE INVENTION

Advances in building requirements and technologies emphasizing energy conservation have resulted in insulated and sealed buildings. As a result, moisture related structural integrity and the indoor air quality (IAQ) management of these types of buildings have become a major concern. In recent years, considerable effort has been made to improve the performance of building envelopes. While this effort has brought about considerable improvements in building performance, water related problems still persist.

What is crucial is having knowledge of the severity and extent of any water intrusion. A critical parameter is the ability of the building materials to store and then disperse excess moisture. When not overwhelmed, buildings can absorb and manage a quantity of moisture. It is only when moisture levels accumulate to a critical level over a measured period of time that issues causing moisture related mould and damage arise.

Early detection and location of building envelope penetration will allow a builder or owner to identify developing problems and to carry out minor repairs. Homeowners, builders, and insurance companies can avoid high costs that are incurred from extensive structural damage, health problems, insurance claims and potential litigation.

Water can collect in a building envelope as a result of infiltration or exfiltration and condensation. Rain storms and condensation can result in small amounts of water leaking into a limited number of locations in the wall and roof assemblies. The building is able to absorb and eliminate limited amounts of moisture. This wetting and drying process is within the normal performance parameters of the building enclosure and should not result in a threshold alarm. Warning of excess moisture levels should be issued only when moisture accumulates and grows in area over an extended period of time.

In assessing the moisture performance of a building envelope several important variables must be measured, assessed and combined to derive an estimate of the risk and corrective action needed. Key parameters include moisture level, duration of moisture event, number of simultaneous events and surface area involved.

Several moisture monitoring systems are described in the literature but all share the common limitation of setting a moisture alarm threshold and a relatively small number of monitored points. This can lead to misinterpretation of the building envelope performance and result in unnecessary and costly opening and repair of otherwise well performing wall and roof assemblies.

There are several types of moisture detection sensors available for detecting water leaks.

In U.S. Pat. No. 6,175,310 (Gott) issued Jan. 16, 2001 there is disclosed an arrangement which uses exposed conductors on a tape of a hygroscopic material where the current across the conductors is detected to detect moisture enveloping the tape.

In U.S. Pat. No. 6,377,181 (Kroll) issued Apr. 23, 2002 there is disclosed an arrangement which uses probes which are each connected to a conductor pair communicating with a central monitor which issues an alarm when moisture above a threshold is detected.

In U.S. Pat. No. 6,144,209 (Raymond) issued Nov. 7, 2000 there is provided an arrangement which describes a location method using a combination of specially designed insulated and detection conductors cabled together in a form helix. This design while useful for detection and location of water on floor like surfaces can not be placed between the roof deck and waterproof membrane because of the large overall dimensions and the susceptibility of the cable design to crushing and shorting.

U.S. Pat. No. 4,502,044 (Farris) issued Feb. 26, 1985 discloses a plurality of sensor elements defined by side by side pairs of conductors which are adapted to be mounted in two walls of a building and which connect to a central control unit. The control unit uses a transistor which acts to detect when voltage across a resistor reaches a value sufficient to turn on the transistor to emit an alarm signal.

British Patent Application 2,235,535 (Stewart) published 1991 discloses a plurality of sensor elements defined by tapes 3 which are mounted in walls of a building and connect to a central control unit in the form of a leak detection U.S. Pat. No. 5,081,422 (Shih) issued Jan. 14, 1992 discloses in general a plurality of moisture sensor elements each defined by a side by side pairs of conductors which have a resistance characteristic which varies in relation to a moisture content. Shih also discloses the use of probes which are connected to the wires and are driven into the material on which the wires are attached.

The present Applicants also disclose arrangements in Published PCT Application WO/05/10837 published Feb. 3, 2005. These arrangements use detection tapes and probes are suited for detecting water intrusion in selected areas of a building structure. The disclosure of the above application of the present Applicant are incorporated herein by reference or may be reviewed for further details not disclosed herein.

Also in U.S. application Ser. No. 11/229,312 filed Sep. 19, 2005 entitled "A MOISTURE DETECTION SENSOR TAPE WITH LEAK LOCATE", which corresponds to Canadian application Serial No: 2,520,202 filed Sep. 19, 2005, is disclosed an improved tape using four conductors which allow a location process to be used to locate the position of the leak along the tape. The disclosure of the above application of the present Applicant are incorporated herein by reference or may be reviewed for further details not disclosed herein.

Also in U.S. application Ser. No. 11/679,673, filed Feb. 27, 2007, "A MOISTURE DETECTION SENSOR TAPE AND PROBES TO DETERMINE SURFACE MOISTURE AND MATERIAL MOISTURE LEVELS", which corresponds to Canadian application Serial No: 2,583,006 is disclosed a moisture detection sensor is used in a building structure to detect moisture penetration. The sensor is a flat adhesive tape of a substrate of dielectric, hydrophobic material. Three or four elongate, parallel, conductors are secured to the top surface and a protective layer of non-hygroscopic, water pervious material is secured over two of the conductors so that they are exposed to surface moisture. One or two of the conductors are covered by an insulating layer to prevent moisture access. Pairs of moisture probes along the length of the tape penetrate the insulating layer, the respective conductors and the substrate and to extend into a building component to which the substrate has been adhered. A diode guide arrangement allows a monitoring unit to monitor the exposed conductors for surface moisture and the penetrated conductors for moisture in the component by reversing polarity of the voltage across the conductors. The disclosure of the above application of the present applicant are incorporated herein by reference or may be reviewed for further details not disclosed herein.

In published US Patent Application 2006/0092031A1 published May 4, 2006 and entitled Building Monitoring System by Vokey is disclosed a building monitoring system which monitors selected zones in a building structure for the presence of moisture. The system uses multiple moisture detectors each installed in the structure at a location to be monitored. A remote sensor unit is associated with each zone to be monitored and is coupled to the detectors in the associated zone. The sensor unit generates an alarm signal having a characteristic uniquely representing the sensor unit and any wet detector to pinpoint any leakage problem. A monitoring unit receives alarm signals from the sensor units, decodes the alarm signals and generates an alarm report reporting the existence and location of any leakage.

SUMMARY OF THE INVENTION

The present invention proposes a system whereby moisture detectors can be integrated extensively into a building structure to monitor for water ingress where the sensors are monitored for moisture levels on the surface of and interior to building components such as sheathing.

According to the present invention, there is provided method of monitoring moisture in a building comprising:

providing a plurality of moisture detectors, each having a detector parameter with a range of values ranging from a dry value in the absence of moisture and different wet values in the presence of moisture depending on the quantity of moisture;

dividing the building into a plurality of zones;

providing a plurality of sensor units each associated with a respective one of said zones;

locating the moisture detectors such that each zone contains at least one of the moisture detectors;

connecting each sensor unit to said at least one moisture detector in the respective zone;

providing a common monitoring unit for cooperation with a plurality of the sensor units;

causing the common monitoring unit to periodically poll each of the sensor units to obtain the value of the detector parameters of the at least one moisture unit connected thereto;

and performing a risk assessment calculation of potential damage for at least a part of the building using the wet values from the moisture detectors for the sensor zones in said at least a part;

wherein the risk assessment calculation is effected using the different wet values from a plurality of the moisture detectors in conjunction with at least one additional factor indicative of potential damage to the part of the building.

Preferably the building is divided into a plurality of separate parts to be included in a separate risk assessment calculation and wherein each part includes a plurality of zones each having a plurality of moisture detectors.

The risk assessment calculation may include as input data therein the wet values and as the additional factor a value which is indicative of a total area of the moisture as provided by the number of sensor zones that are responding with a wet value and/or the number of consecutive time periods that the sensor zone has reported wet values.

The risk assessment calculation may use modeling to determine a risk factor for growth of mold. For example the modeling may be taken from Sedlbauer, K Krus M, Zilli, W et al 2001 Mold growth prediction by Computational Simulation. ASHRAE-Konferenz IAQ 201 San Francisco, or from Smith, S L and Hill S T 1982 Influence of Temperature and Water activity on Germination and Growth of Aspergillus Restrictus and Aspergillus Versicolr Trans Br Mycol Soc 79 (3) pp 558 to 560, the disclosures of both f which are incorporated herein by reference.

Alternatively the risk assessment calculation can use modeling to determine a risk factor for growth of timber decay fungi. For example the modeling may be taken from Winandy J E and Morell J J 1992 Relationship between Incipient Decay, Strength and Chemical Composition of Douglas Fir Heartwood Wood Fiber Science Vol 25 (3) pp 278 to 288.

Preferably there is provided a temperature sensor and the moisture level calculation includes temperature compensation.

Preferably the moisture detectors comprise a tape having at least two parallel spaced conductors thereon and a plurality of probes inserted through the conductors at spaced positions therealong and wherein the moisture level calculation includes as input data the number of probes on the tape.

Preferably the moisture level calculation includes as input data moisture-resistance curves for a material on which the tape is applied.

In one example the tape is located at the floor plate of a wall in the zone. Alternatively or additionally the tape may be located under penetrations such as a window of a wall in the zone.

In one example the risk assessment calculation is calculated using the following formula:

$$REL = \frac{1}{mxn}\sum_{k=1}^{m}\sum_{i=1}^{n} LR_k(i) \tag{1}$$

where REL is the potential average accumulated over all zones in an elevation, m is the number days, n is the total number of zones in the evaluation, $LR_k(i)$ derived from building science modeling for mold growth, is the potential loss of material strength in % caused by the growth of damaging mold on the $i_{th}$ day as a function of the average moisture content and temperature during the day.

In one preferred arrangement each sensor unit is operable when polled to respond to a coded signal having a characteristic uniquely representing the sensor unit.

Preferably the tape includes two conductors through which the probes are inserted.

In particular the tape may include two conductors for surface moisture and two conductors through which the probes are inserted for material moisture.

Thus the sensor unit associated with each said zone is coupled to one or more of the detectors in the associated zone, the sensor unit being operable to respond to a coded signal having a characteristic uniquely representing the sensor unit.

Upon receiving said coded signal it will measure the response of the detectors to which it is coupled and relay the measured response to the central computer receiving unit.

The currently preferred embodiments of the invention include a monitoring circuit connecting the remote sensors for delivering power and actuation signals to the sensors and delivering moisture measurement signals from the sensor units to the monitoring unit. It is also possible to provide wireless communication between the sensor units and the monitoring unit, but an alternative sensor powering system would be required.

Thus the monitoring unit or a centrally located monitoring center which receives sensor information from a plurality of monitoring units, performs a risk assessment calculation using the moisture level reading for each sensor zone, the number of sensor zones that are responding with higher than normal moisture levels, and the number of consecutive time periods that the sensor zone has reported high moisture levels.

This system and risk assessment method allows the identification of the presence of critical moisture exposure at any area in the building where a detector is located, allowing maintenance personnel to identify and ameliorate leakage before it becomes a problem while avoiding the problem of overreaction that results from threshold based moisture alarm systems.

It is preferred to configure the sensors to report so that areas of concern are mapped out on the building plan elevations.

The detectors which are fully described in the above applications of the present Applicants include tapes constructed with a pair of copper conductors laid parallel on a dielectric substrate. In a dry state the detection tape appears as an open circuit. Water bridging the space between the conductors will produce a conductive path between the conductors having a resistance in the order of a few thousand ohms or less, the detector parameter is in this case electrical resistance, although other parameters, particularly electrical parameters may be used depending on the design of the detectors. As described in the earlier patent applications, the detectors may also include substrate penetrating probes for detecting absorbed moisture in structural components. The detectors, sensor units and monitoring circuit are installed in the building structure at the time of construction and remain in place for the life of the structure.

Each sensor unit is assigned to a particular building area, with the associated detector tapes located at respective critical zones where water problems may occur within that area.

In the currently preferred embodiments of the system, the sensor units are connected in series in the monitoring circuit. When polled, each sensor unit transmits several signals representing respectively the moisture levels of the detectors connected to the input ports. In the currently preferred embodiments, up to one hundred sensor units can be placed on a single monitoring circuit, thus enabling the monitoring of a large number of zones in various building areas, each with a unique digital code.

The computer-controlled monitoring unit applies a low voltage powering DC across the monitoring circuit to energize the sensor units. The same circuit is used to receive the coded signals from the sensor units and to test for continuity and functionality of the circuit.

Once polled, a sensor unit applies a measuring voltage to the moisture-detection conductors. The resistance of the conductive path in each detector connected to the sensor is measured and the value transmitted back to the monitoring unit. The zone code is unique and is linked to a database preprogrammed into the monitoring unit to correlate moisture levels, the zone codes and the monitored zones. A risk assessment is then calculated and a report is then generated by the monitoring unit detailing the exact location of any area in the building requiring attention.

The present invention preferably uses as detectors the moisture detection tape and probes of the above mentioned patent applications. Each tape is connected to a sensing input of a remote zone sensor that assigns a digitally coded address to the zone to be monitored. The remote zone sensor reports over a pair of monitoring conductors to a computer-based monitoring system. The monitoring system energizes the monitoring conductors and checks for moisture levels at regular intervals.

BRIEF DESCRIPTION OF THE DRAWINGS

One embodiment of the invention will now be described in conjunction with the accompanying drawings wherein the showings are for the purposes of illustrating the preferred embodiment of the invention only and not for purposes of limiting same, in which.

DETAILED DESCRIPTION OF THE PREFERRED EMBODIMENT

Figure 1:
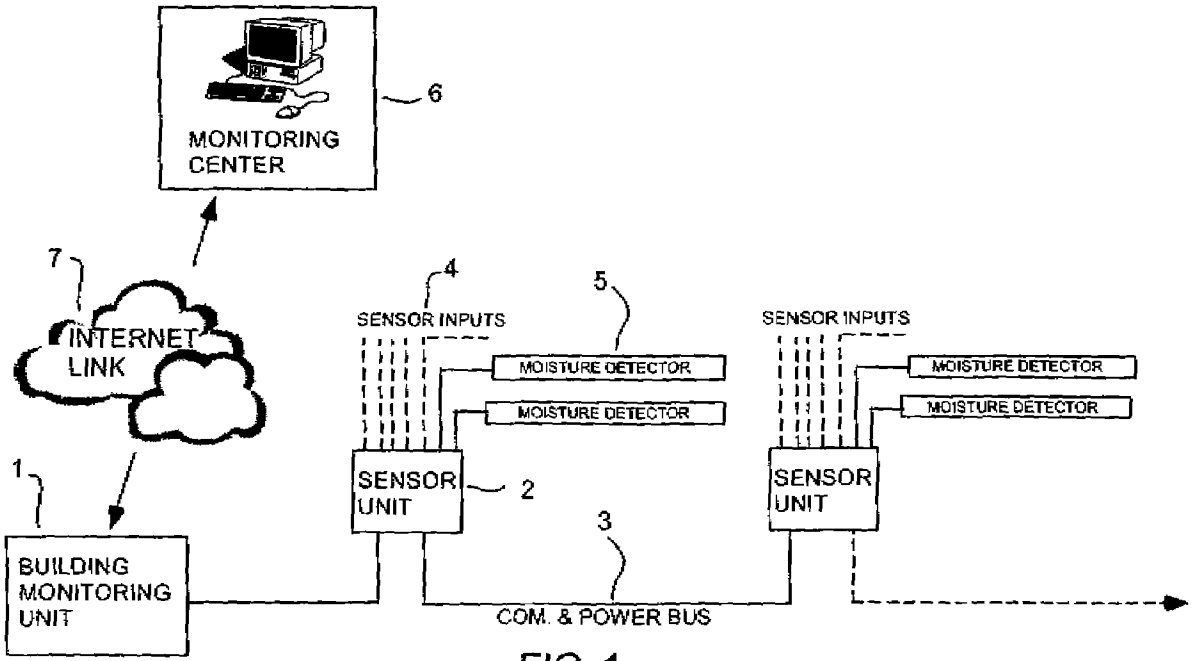
FIG. 1 is an illustration of the monitoring system as typically installed in a building.

Referring now to the drawings, the overall arrangement of the subject moisture detection system can best be seen with reference to FIG. 1. The building installed components include the computer based building monitoring unit 1, a plurality of sensor units 2 each having a plurality of inputs 4 for connection to individual moisture detectors 5, and a communication and sensor powering bus 3. The building monitoring unit 1 is linked to the monitoring center 6 via the internet 7 or other suitable network link. At preprogrammed intervals, the building monitoring unit 1 polls the sensor units 2 which then initiate a measurement sequence measuring the individual moisture detectors 4, 5. The sensor units 2 then transmit the measured value along with the input identification code back to the monitoring unit 1. This sequence is repeated until all the sensors on the bus 3 have been queried. The measured values from the moisture detector zones are then forwarded to the monitoring center 6. The monitoring center computer 6 calculates the REL level and reports the results.

Typically the building is divided into separate areas defined by the four separate elevations of the building since these are responsive to different weather effects.

Figure 2:
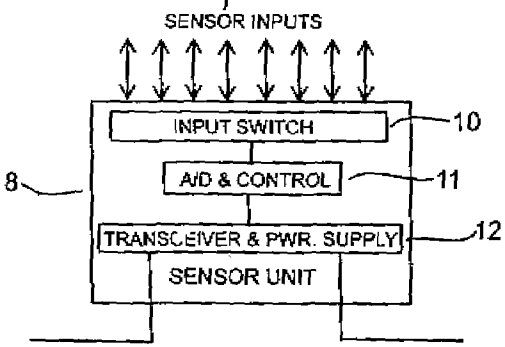
FIG. 2 is an illustration of the functional design of the sensor unit.

Referring to FIG. 2, the detailed operation of the sensor unit 2 is illustrated. Individual moisture detectors 5 are connected to one of the sensor input ports 4. The input ports 4 are terminated on an input selector switch 10. The control and A/D circuits 11 select the input port 4 to be tested and apply a measuring voltage to the selected port. The measured analog value is converted to a digital value by the A/D converter 11 and forwarded to the transceiver 12. The transceiver relays the data to the building monitoring unit for processing and storage.

The described communication and control between the monitoring center, building monitoring unit and sensor units can be accomplished using wireless networks. In particular, the communication between the building monitoring unit and sensor unit can be implemented using a wireless mesh network which would provide a robust link between the units.

Figure 3:
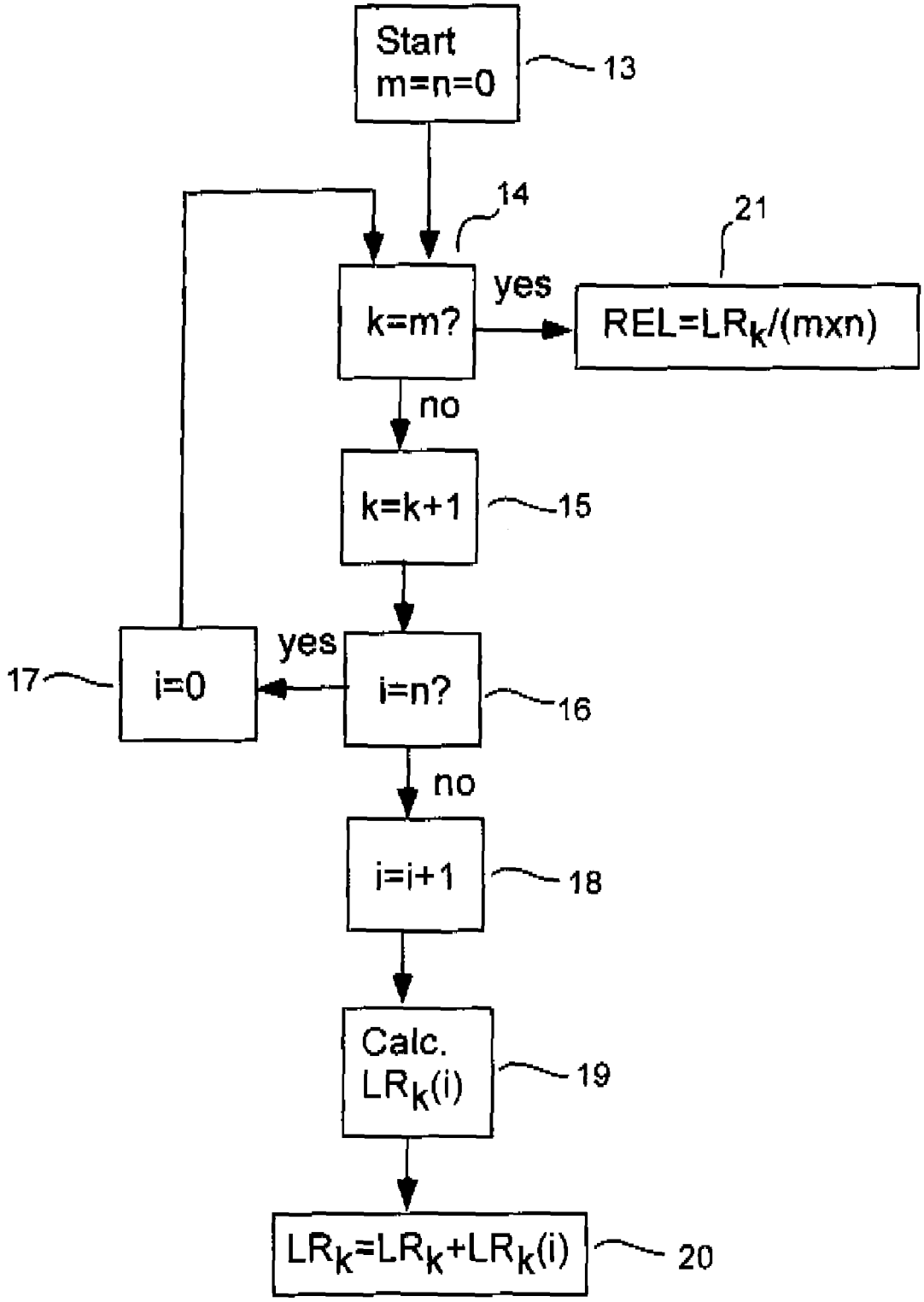
FIG. 3 is a diagram of the logic flow during the calculation of the REL value for a selected building assembly.

Referring to FIG. 3, the flow chart details the double numerical integration method used to calculate the REL value. The monitoring center collects the data from all the monitored detection zones in every monitored building. The collected data from individual buildings is processed to evaluate the REL level. The number of zones (n) of the building and number of days (m) to be included in the calculation are inputted into the initial conditions and the analysis initiated 13.

Counter k is set to 1 by at step 15. Counter i is set to 1 at step 16. Based on the moisture level and mold growth rate constants the $LR_k$ for the ith detection zone is calculated 19 and added to the running summation 20. The process is then directed back to step 16 where i is tested for a value of n and then passed onto steps 18 to 20 until i reaches the value of n. When i reaches the value of n, i is reset to a value of 0 at step 17 and the process is directed to step 14 where k is tested for a value of m and the incremented by a value of 1 at step 15. These process loops continue until k=m at which time the REL for the building zones is calculated at step 21.

A report of the results is then generated for review. Typically the report containing the REL is generated monthly. Typically a period over which it is necessary for the moisture to be present is at least 7 days bearing in mind that the probability of damage or the REL is low when only a single time period or a small number of such time periods of moisture penetration is involved.

The present arrangement provides a system for a more effective prediction of damage to the building thus replacing the conventional mere threshold driven techniques of the prior art where a single penetration leads to an alarm condition regardless of the likelihood of actual damage occurring requiring remedial work to overcome the problem Other mathematical computation methods may be used to generate a value for REL. The method given above is a step wise numerical integration technique.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of monitoring moisture in a building comprising:

providing a plurality of moisture detectors, each having a detector parameter with a range of values ranging from a dry value in the absence of moisture and different wet values in the presence of moisture depending on the quantity of moisture;

dividing the building into a plurality of zones;

providing a plurality of sensor units each associated with a respective one of said zones;

locating the moisture detectors such that each zone contains at least one of the moisture detectors;

connecting each sensor unit to said at least one moisture detector in the respective zone;

providing a common monitoring unit for cooperation with a plurality of the sensor units;

each of the sensor units providing the value of the detector parameters of the at least one moisture unit connected thereto;

and performing a risk assessment calculation of potential damage for at least a part of the building using the wet values from the moisture detectors for the sensor zones in said at least a part;

wherein the risk assessment calculation is effected using the different wet values from a plurality of the moisture detectors in conjunction with at least one additional factor indicative of potential damage to the part of the building;

and wherein the risk assessment calculation includes as input data therein the wet values and as a first additional factor a value which is indicative of a total area of the moisture as provided by the number of sensor zones that are responding with a wet value and as a second additional value the number of consecutive time periods that the sensor zone has reported wet values.

2. The method according to claim 1 wherein the risk assessment calculation uses modeling to determine a risk factor for growth of mold.

3. The method according to claim 1 wherein the risk assessment calculation uses modeling to determine a risk factor for growth of timber decay fungi.

4. The method according to claim 1 wherein there is provided a temperature sensor and the moisture level calculation includes temperature compensation.

5. The method according to claim 1 wherein the moisture detectors comprise a tape having at least two parallel spaced conductors thereon and a plurality of probes inserted through the conductors at spaced positions therealong and wherein the moisture level calculation includes as input data the number of probes on the tape.

6. The method according to claim 5 wherein the moisture level calculation includes as input data moisture-resistance curves for a material on which the tape is applied.

7. The method according to claim 5 wherein the tape is located at the floor plate of a wall in the zone.

8. The method according to claim 5 wherein the tape is located under window penetrations of a wall in the zone.

9. A method of monitoring moisture in a building comprising:

providing a plurality of moisture detectors, each having a detector parameter with a range of values ranging from a dry value in the absence of moisture and different wet values in the presence of moisture depending on the quantity of moisture;

dividing the building into a plurality of zones;

providing a plurality of sensor units each associated with a respective one of said zones;

locating the moisture detectors such that each zone contains at least one of the moisture detectors;

connecting each sensor unit to said at least one moisture detector in the respective zone;

providing a common monitoring unit for cooperation with a plurality of the sensor units;

each of the sensor units providing the value of the detector parameters of the at least one moisture unit connected thereto;

and performing a risk assessment calculation of potential damage for at least a part of the building using the wet values from the moisture detectors for the sensor zones in said at least a part;

wherein the risk assessment calculation is calculated using the following formula:

$$REL = \frac{1}{mxn}\sum_{k=1}^{m}\sum_{i=1}^{n} LR_k(i) \tag{1}$$

where REL is the potential average accumulated over all zones in an elevation, m is the number days, n is the total number of zones in the evaluation, $LR_k(i)$ derived from building science modeling for mold and/or timber decay fungi growth, is the potential the growth of mold on the $i_{th}$ day as a function of the average moisture content obtained from the values of the moisture detectors and temperature during the day.

10. The method according to claim 5 wherein the tape includes two conductors through which the probes are inserted.

11. The method according to claim 5 wherein the tape includes two conductors for surface moisture and two conductors through which the probes are inserted for material moisture.

12. The method according to claim 1 wherein the sensors are configured to report so that areas of concern determined by the risk assessment calculation are mapped out on the building plan elevations.

13. The method according to claim 9 wherein the moisture detectors comprise a tape having at least two parallel spaced conductors thereon and a plurality of probes inserted through the conductors at spaced positions therealong and wherein the moisture level calculation includes as input data the number of probes on the tape.

14. The method according to claim 13 wherein the moisture level calculation includes as input data moisture-resistance curves for a material on which the tape is applied.

15. The method according to claim 13 wherein the tape includes two conductors through which the probes are inserted.

16. The method according to claim 13 wherein the tape includes two conductors for surface moisture and two conductors through which the probes are inserted for material moisture.

17. The method according to claim 9 wherein the sensors are configured to report so that areas of concern are mapped out on the building plan elevations.

* * * * *